United States Patent [19]

Kogane et al.

[11] Patent Number: 4,903,064

[45] Date of Patent: Feb. 20, 1990

[54] PHOTOGRAPHIC PROCESSING APPARATUS

[75] Inventors: Mikio Kogane; Shigemi Saito, both of Tokyo; Tadatosi Koyama, Kanagawa, all of Japan

[73] Assignee: Fuji Photo Film Co., Ltd., Kanagawa, Japan

[21] Appl. No.: 308,588

[22] Filed: Feb. 10, 1989

[30] Foreign Application Priority Data

| | | | |
|---|---|---|---|
| Feb. 12, 1988 | [JP] | Japan | 63-30537 |
| Feb. 12, 1988 | [JP] | Japan | 63-30538 |
| Feb. 12, 1988 | [JP] | Japan | 63-30539 |
| Feb. 12, 1988 | [JP] | Japan | 63-30540 |
| Feb. 12, 1988 | [JP] | Japan | 63-30541 |

[51] Int. Cl.[4] ..... G03D 3/13

[52] U.S. Cl. ..... 354/321; 354/322; 354/338; 226/199

[58] Field of Search ..... 354/320, 321, 322, 338, 354/339; 226/196, 198, 199

[56] References Cited

U.S. PATENT DOCUMENTS 4,666,279 5/1987 Fujita et al. ..... 354/339

4,719,484 1/1988 Tahara et al. ..... 354/320

*Primary Examiner*—A. A. Mathews

*Attorney, Agent, or Firm*—Sughrue, Mion, Zinn, Macpeak & Seas

[57] ABSTRACT

A photographic processing apparatus having a plurality of processing tanks and a guide rack structure detachably mounted thereon for guiding a long strip of photographic material passing through the tanks. The guide rack structure has a pair of guide members removably installed into each of the tanks, and each pair is movable to define the width of guide passage therebetween and thus guide lengthwise edges of the long strip passing through the tank. Width adjusting mechanisms are provided, one for each pair of guide members, for adjusting the width of guide passage so that it is equal to the width of the long strip of photographic material. A drive mechanism is coupled to all the pairs of guide members to drive the width adjusting mechanisms and thus effect width adjustment. A power transmission is provided between the drive mechanism and each width adjusting means for connecting and disconnecting the transmission of drive power from the drive mechanism to the width adjusting means.

20 Claims, 7 Drawing Sheets

PHOTOGRAPHIC PROCESSING APPARATUS

BACKGROUND OF THE INVENTION

The present invention relates to a photographic processing apparatus for printing long strips of photographic material by processing them in multiple processing chambers, and more particularly to a photographic processing apparatus which has a guide structure including strip guide racks for guiding long strips of photographic material through in multiple processing chambers. The guide racks are variable in width according to the sizes of the long photographic strip materials.

Various photographic processing apparatus are well known to those skilled, for example, in the photographic art. Such a photographic processing apparatus generally has various chambers or sections, such as an exposing or printing section, developing section, drying section and cutting section. A long strip of photographic material such as photographic paper is withdrawn from a magazine to an exposure station in the printing section to effect exposure. After exposure, the long strip of photographic material is transported into the developing section and, then, into the drying section. Finally, the processed long strip of photographic material is cut into individual pieces, such as prints, in the cutting section.

For guiding the long strip of photographic materials into the processing section, the photographic processing apparatus is provided with a pair of strip guide racks in every processing chamber. The racks of each pair are disposed so that they face one another but are separated from each other to define the width of the strip passage. The strip guide racks are removably hung in each processing chamber and cooperate with each other so that the distance between them is changeable. As a result, the width of passage for long strips of photographic material can be varied.

Because the pairs of strip guide racks operate independently from one another the removal, installation and adjustment of the width of the plurality of strip guide racks have to be independently carried out for each chamber.

OBJECT OF THE INVENTION

It is, therefore, an object of the present invention to provide a photographic processing apparatus in which the distance between the guide members of all of the guide rack structures installed in processing tanks is adjusted simultaneously to a width of a long strip of photographic material passing through the processing tanks.

SUMMARY OF THE INVENTION

The above and other object of the present invention are achieved by providing a photographic processing apparatus which has a plurality of processing tanks and a guide rack structure detachably mounted on the processing tanks for guiding a long strip of photographic material passing through the processing tanks. The guide rack structure includes pairs of guide members removably installed into each of the processing tanks, and which can be moved closer to and further apart from each other in order to vary the width of the guide passage formed therebetween to guide the lengthwise edges of the long strip of photographic material passing through the processing tank. A width adjusting means is provided in association with each pair of guide members for adjusting the width of the guide passage so it is equal to the width of the long strip of photographic material. Transmission means are provided, one for each guide rack structure for coupling the drive means and the width adjusting means together to connect and disconnect the transmission of drive power of the drive means to the width adjusting means. All of the width adjusting means are driven by drive means mounted on the processing apparatus to adjust the width of guide passage.

According to a preferred embodiment of the present invention, the transmission means couples the drive means and the width adjusting means together only when the pair of guide members are moved to their outermost points of movement, for example to a position where the guide members are moved to form the widest guide passage therebetween, upon installing the guide rack structure into the processing tank.

According to another preferred embodiment of the present invention, the transmission means includes a clutch means, such as a friction coupled clutch or an electric solenoid clutch, located between the drive means and the width adjusting means for connecting and disconnecting the transmission of drive power from the drive means to the width adjusting means. The transmission of drive power is disconnected when the pair of guide members are moved to the outermost positions of movement upon installation of the guide rack structure into the processing tank. The disconnection of the transmission of drive power from the transmission means can be detected independently by sensors provided in the guide structures. The sensors may include sensors such as a position sensor for detecting a specific angular position of rotation of the width adjusting means or a sensor for detecting motion of the width adjusting means. When the disconnection of power transmission from all of the transmission means is detected, the rotation of the drive means is reversed to adjust the width between the guide members so it is equal to the width of the long strip of photographic material.

In the embodiments of the invention, since the guide members of all of the installation of the guide rack structures can be positioned at their initial position in the guide rack structures in the processing apparatus, the guide rack structures can all be adjusted simultaneously to the desired width for the guide passage between the guide members.

BRIEF DESCRIPTION OF THE DRAWINGS

The above described and other objects of the present invention will become apparent from the following description taken in conjunction with preferred embodiments thereof with reference to the accompanying drawings in which same reference numerals designate same or similar parts throughout several views and wherein.

DETAILED DESCRIPTION OF THE INVENTION

Figure 1:
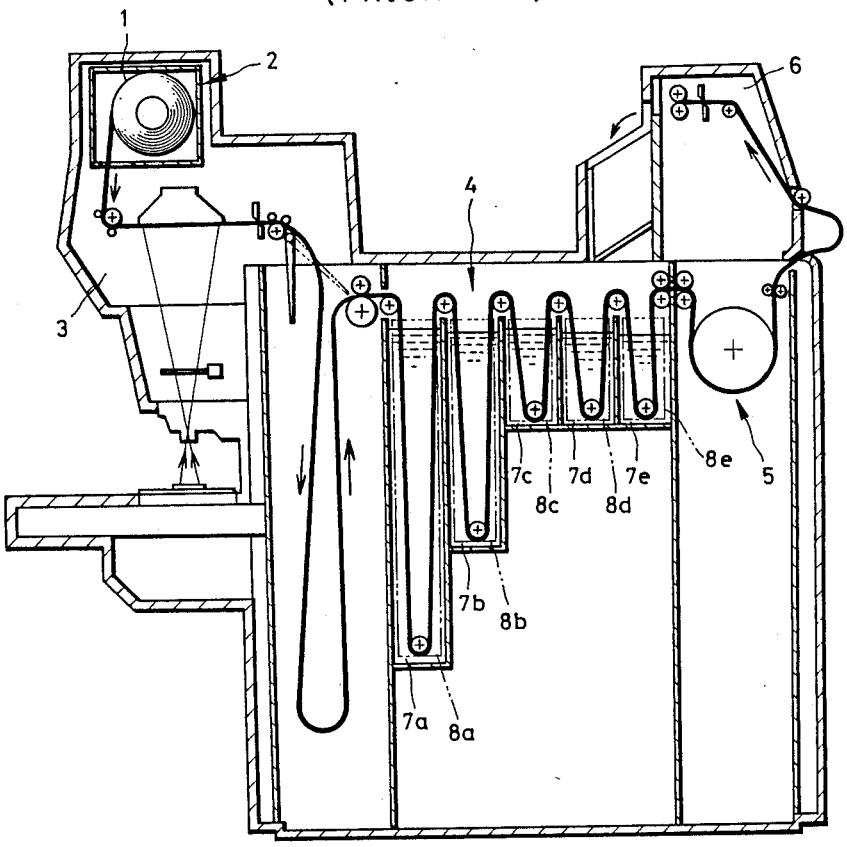
FIG. 1 (PRIOR ART)
FIG. 1 is a fragmentary sectional view showing a photographic processing apparatus in which the present invention is embodied.
Figure 2:
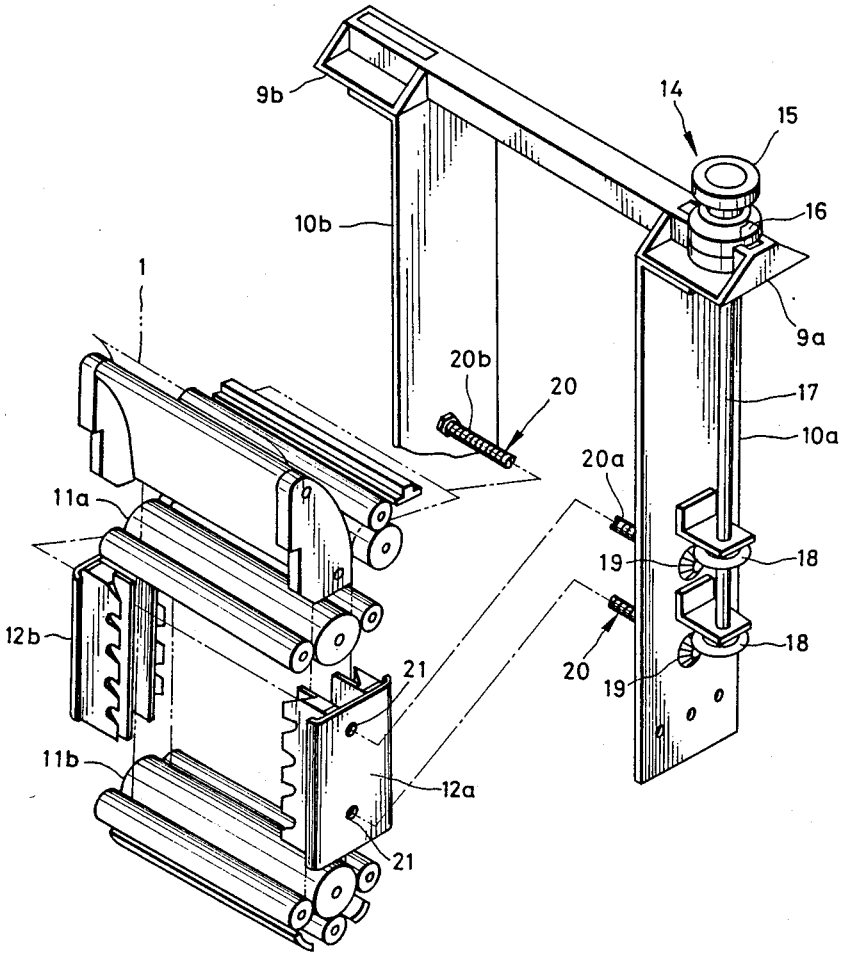
FIG. 2 (PRIOR ART)
FIG. 2 is a schematic illustration showing guide rack structures incorporated in the photographic processing apparatus shown in FIG. 1.

Before describing the present invention in detail, reference is made to FIGS. 1 and 2 for the purpose of providing a brief background that will enhance the understanding of the operation of a conventional photographic processing apparatus in which the present invention is employed.

Referring now to FIG. 1, shown therein is a conventional photographic processing apparatus in which the present invention is employed. As shown, the photographic processing apparatus mainly comprises a printer section 3, a paper processing section 4, a color paper drying section 5 and a cutting section 6. A paper magazine 2 in which a roll of a long strip of color paper 1 is contained, is removably mounted on the top of the apparatus. The color paper 1 is withdrawn one frame at a time in a well known manner and placed in position at the exposure section 3.

In the paper processing section 4 for photographically processing the exposed color paper 1, there are various processing tanks, namely a developing tank 7*a*, a bleaching-fixing tank 7*b*, and three consecutive washing tanks 7*c* to 7*e*. The exposed color paper 1 passes through these processing tanks 7*a* to 7*e* to effect color processing. In these processing tanks 7*a* to 7*e*, there are removably suspended or hung guide rack structures 8*a* to 8*e* which guide the long strip of color paper 1.

The guide rack structures, which have the same construction and operation, are exemplarily illustrated in FIG. 2. As shown, the guide rack structure 8 includes a pair of side plates 10*a* and 10*b* with hooks 9*a* and 9*b* provided at one end thereof. Also provided are guide rolls 11*a* and 11*b* rotatably supported between the side plates 10*a* and 10*b* for forming the long strip of color paper 1 into a loop and transporting it through each processing tank. A pair of channel members 12*a* and 12*b* are disposed between the rolls 11*a* and 11*b* for guiding both side edges of the long strip of color paper 1. A width adjusting mechanism 14 is provided for adjusting the distance between the guide channel members 12*a* and 12*b* by moving them apart from or toward each other according to the width of the color paper 1.

The width adjusting mechanism 14 includes an adjusting dial 15 mounted on the top of the side plate 10*a*, a scale dial device 16, a vertical rotary shaft 17 connected as a common driving member to the adjusting dial 15 and rotatably supported by brackets secured to the side plate 10*a*, and a pair of screw rods 20 supported between the side plates 10*a* and 10*b*. Each rod 20 has a bevel gear 19 at its end which meshes with a bevel gear 18 secured to the vertical rotary shaft 17. Each screw rod 20 has two male screw sections having opposite directional threads. According to the width adjusting mechanism 14, the rotation of the adjusting dial 15 moves the guide channel members 12*a* and 12*b* closer to or further apart from each other, changing the distance between the guide channel members 12*a* and 12*b*.

Figure 3:
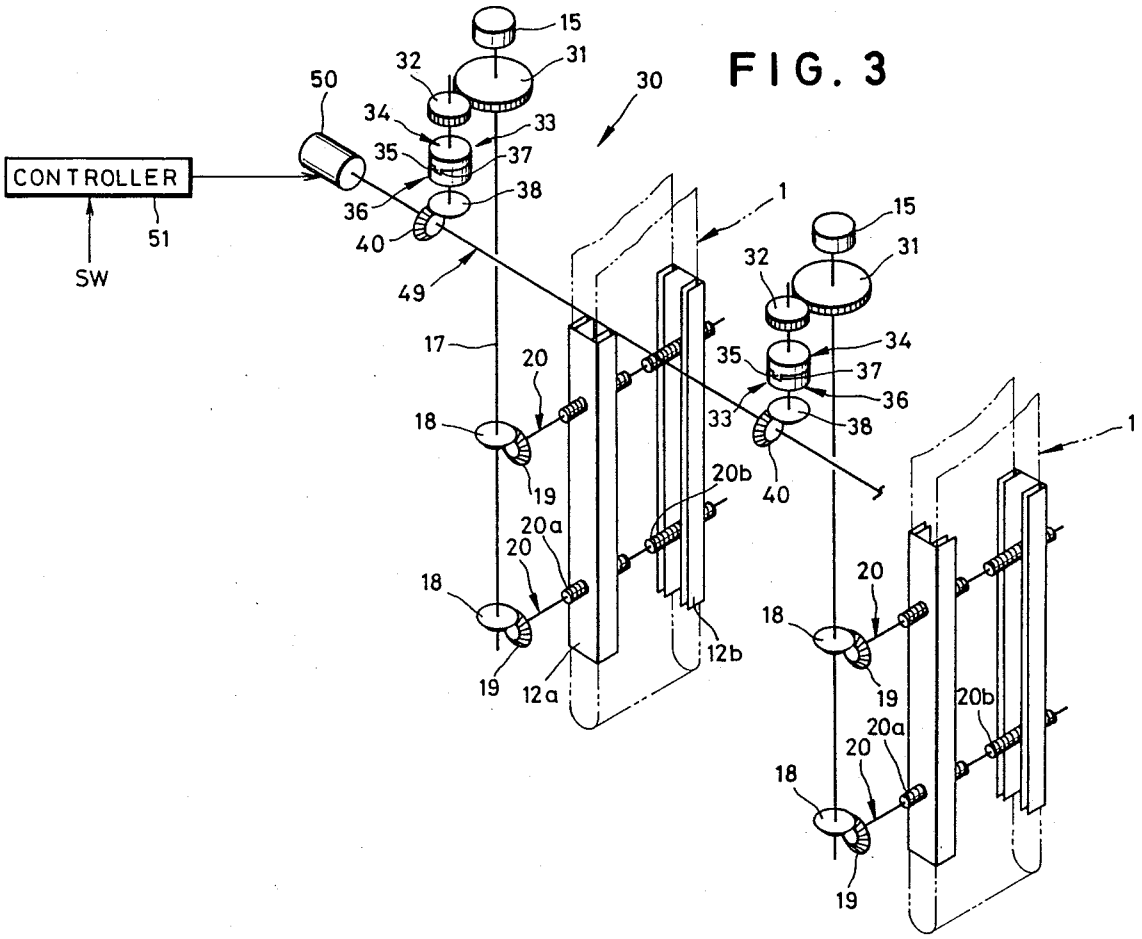
FIG. 3 is a schematic perspective view showing the essential part of a photographic processing apparatus according to a preferred embodiment of the present invention.
Figure 5:
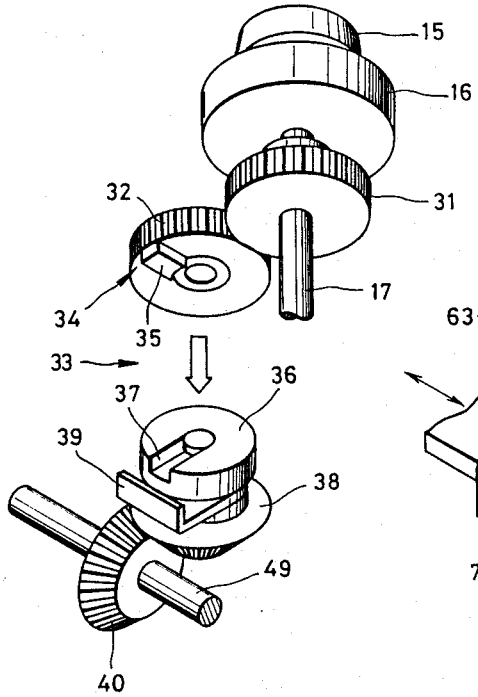
FIG. 5 is an exploded perspective view showing the power transmission shown in FIG. 4.

Referring now to FIGS. 3 and 5 a printing-processing apparatus is illustrated in which parts identical to parts of the conventional one shown in FIGS. 1 and 2 are designated by the same reference numerals and therefore are not explained in detail herein.

As shown in FIG. 3, a width adjusting mechanism 30 for each of the respective processing tanks 7*a* to 7*e* is incorporated in the conventional photographic processing apparatus shown in FIG. 1 and cooperates with the guide channel members 12*a* and 12*b* shown in FIG. 2. The width adjusting mechanism 30 includes an interface gear 32 rotatably mounted on one edge of the guide rack structure. Interface gear 32 meshes with a drive gear 31 mounted on the vertical rotary shaft 17 when the width adjusting mechanism 30 is removably installed in the processing tank.

The width adjusting mechanism 30 further includes a mechanical clutch 33, shown in detail in FIG. 5, having an upper clutch disk 34 formed with a spline key 35, which is integral with the interface gear 32, and a lower clutch disk 36 formed with a spline groove 37 which is engaged with the spline key 35. The lower clutch disk 36 is rotatably supported by a bracket 39 secured to the processing tank. The mechanical clutch 33 connects and disconnects the transmission of rotation from a motor 50 to the drive gear 31 through the interface gear 32. The bevel gear 38 is integrally connected to the lower clutch disk 36 and meshes with a bevel gear 40 mounted on a horizontal rotary shaft 49 extending over the processing tanks 7*a* to 7*e*.

The motor 50 is connected to one end of a horizontal rotary shaft 49 and is controlled by means of a controller 51 which receives a paper width signal SW. This paper width signal SW is preferably provided automatically by a so-called DX code sensor. The paper magazine 2 may have a binary code member which may be in the form of an electric conductive contact located in at least one of, for example, four different code positions. The presence or absence of a code contact in each of the four possible code positions defines a four-bit binary number (in 0's and 1's) which represents the width of a long strip of color paper 1 in the magazine 2. The presence or absence of respective code contacts in the four code positions of the magazine 2 are detected by a contact sensing switches to determine the width of the long strip of color paper 1. Alternatively, the paper width of the long strip of color paper 1 may be manually entered through a keyboard by an operator.

The controller 51 controls the motor 50 so that it rotates in a desired direction according to a paper width signal SW from the DX code sensor to move the guide channel members 12*a* and 12*b* toward or away from each other thus adjusting the distance between the guide channel members 12*a* and 12*b* to the width of the long strip of color paper 1.

When the guide rack structures are all installed after maintenance or repair, the upper and lower clutch disks 34 and 36, in particular the spline key 35 and groove 37 thereof, usually do not meet each other and are out of coupling. In this case, the adjusting dial 15 is rotated to turn the lower clutch disk 36 until the spline groove 37 is brought into alignment with the spline key 35 of the upper clutch disk 34. In this way all the pairs of guide channel members 12*a* and 12*b* are separated by the same distance. Thereafter, the controller 51 receives a paper width signal SW and actuates the motor 50 to move the guide rack members 12*a* and 12*b* toward or away from each other according to the paper width signal SW. Thus, the distance between the guide channel members 12*a* and 12*b* of each guide rack structure is adjusted to the width of the color paper 1. In such a manner, the distance between the guide channel members 12*a* and 12*b* of all of the guide rack structures can be adjusted simultaneously to any desired width according to the paper width signal SW.

Figure 4:
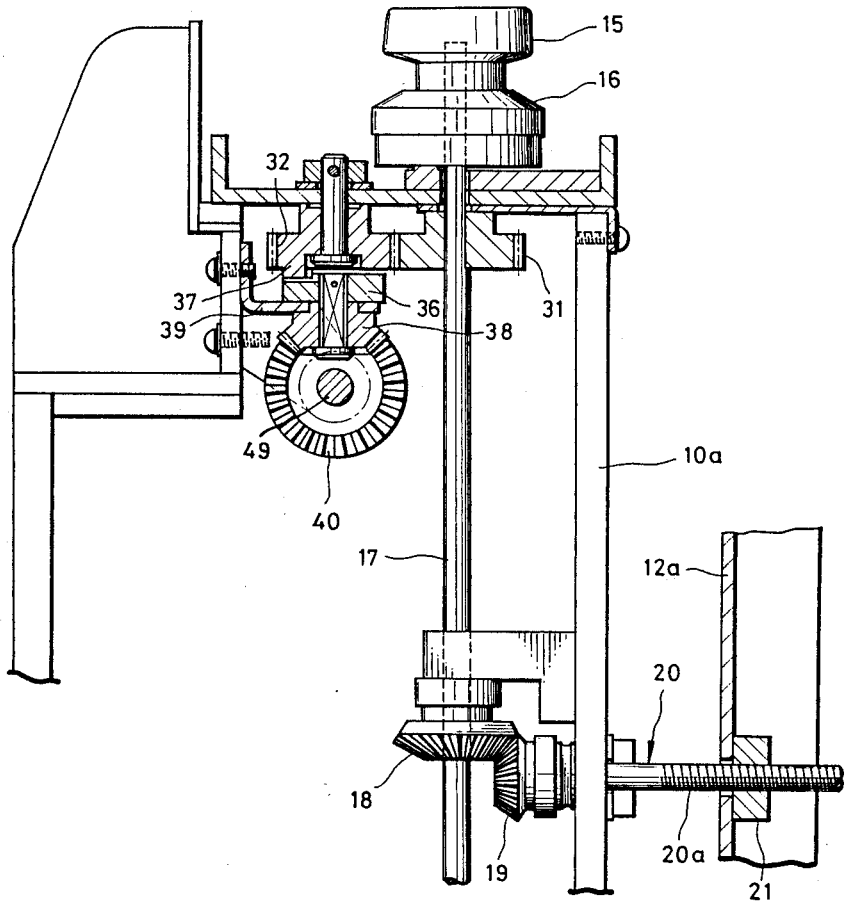
FIG. 4 is a front view showing, partly in cross section, a power transmission used in the photographic processing apparatus shown in FIG. 3.
Figure 6:
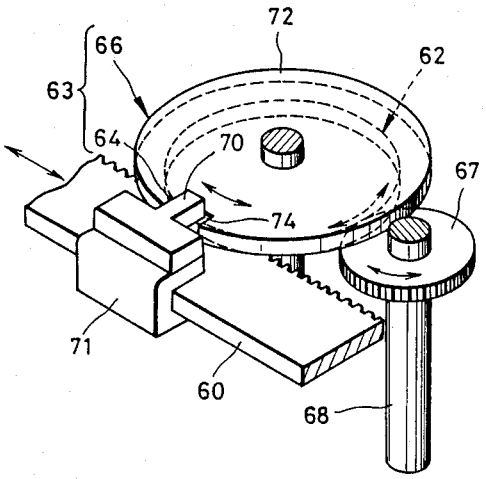
FIG. 6 is a perspective view showing a power transmission alternatively used in the photographic processing apparatus shown in FIG. 3.
Figure 7:
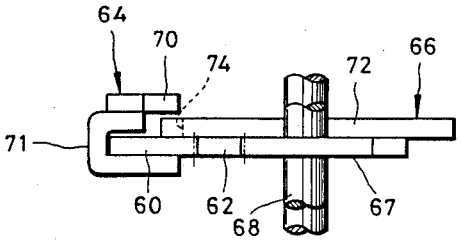
FIG. 7 is a side view showing the power transmission shown in FIG. 5.

The horizontal rotary shaft 49 used as a common driving member for all of the guide rack structures and the mechanical clutch 33 can have a different structure than that shown in FIGS. 3–5. As shown in FIGS. 6 and 7, a drive plate 60, having a rack 60*a* integrally formed on a side thereof, extends over the processing tanks 7*a* to 7*e* and is provided in place of the horizontal rotary shaft 49 shown in FIG. 3. This drive plate 60 is movable in the lengthwise direction. A pinion gear 62 meshes with the rack 60*a* of the drive plate 60. The pinion gear 62 meshes with the drive gear 31 secured to the vertical rotary shaft 17 shown in FIG. 2. A position limiter 63 is provided having positioning members 64 and 66. The positioning member 64 is mounted on a bracket 71 which acts as a guide rail for guiding the drive plate 60 and has a projecting member 70. The positioning member 66 includes a positioning disk 72 having a positioning opening 74. The positioning opening 74 can receive the projecting member 70 only when the guide channel members 12*a* and 12*b* are correctly positioned. The positioning disk 72 has a diameter larger than the pinion gear 62 and is integral with the pinion gear 62. If the projecting member 70 is received in the positioning opening 74, the guide channel members 12*a* and 12*b* are positioned at the outermost point of movement.

As apparent from the above, the guide rack structure can only be correctly installed in the processing tank 7 when the positioning opening 74 of the positioning disk 72 is positioned to receive the projecting member 70 of the positioning member 64. On the other hand if the positioning opening 74 of the positioning disk 72 is not radially in alignment with the positioning opening 74 of the positioning disk 72, the guide rack structure cannot be correctly installed in the processing tank 7 due to abutment of the projecting member 70 against the periphery of the positioning disk 72.

In this embodiment, when the guide rack structure is to be removed from the processing tank 7, it is necessary to move the guide channel members 12*a* and 12*b* by sliding the drive plate 60 to turn the pinion gear 62, thereby radially aligning the positioning opening 74 with the projecting member 70. In order to enable the drive plate 60 to slide after the disconnection of power it is preferred that a manually operated handle be provided between the motor 50 and the drive plate 60 for moving the drive plate 60 in the opposite directions.

Figure 8:
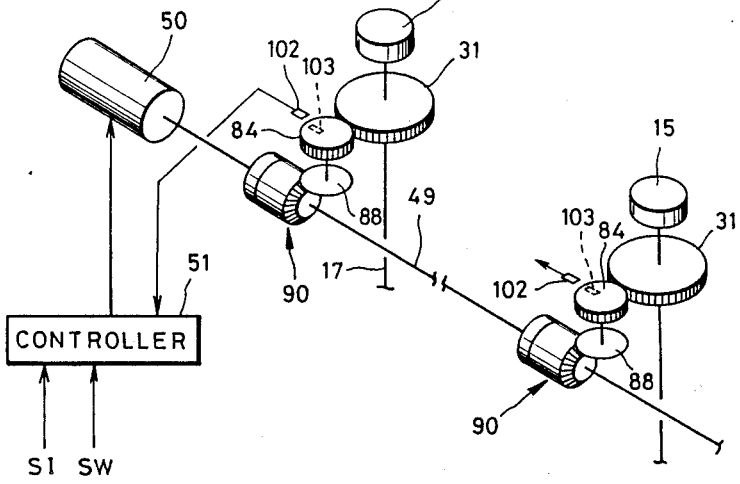
FIG. 8 is a schematic perspective view similar to FIG. 3, showing the essential part of a photographic processing apparatus according to another preferred embodiment of the present invention.
Figure 9:
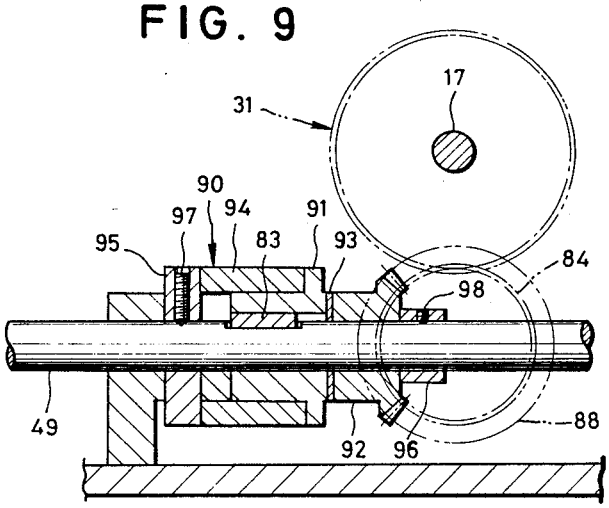
FIG. 9 is a cross sectional view showing a power transmission alternatively used in the photographic processing apparatus shown in FIG. 8.

Referring now to FIGS. 8 and 9, another preferred embodiment of the present invention is shown. Because the printing-processing apparatus of this embodiment is identical to that shown in FIGS. 3 to 5, except for a width adjusting mechanism, the following description will be directed to the width adjusting mechanism 80.

As shown in FIG. 8, the width adjusting mechanism 80 includes an idler gear 84, with a bevel gear 88, which meshes with the drive gear 31 securely mounted on the vertical rotary shaft 17. The bevel gear 88 meshes with a bevel gear 114 of a transmission 90, which will be described in detail later, when the width adjusting mechanism 80 is removably installed in the processing tank 7.

The horizontal rotary shaft 49 is provided with friction coupled transmission devices 90, one for each guide rack structure, for frictionally connecting and disconnecting the transmission of rotation from the horizontal rotary shaft 49 to the bevel gear 88. The friction coupled transmission device 90, shown in FIG. 9, comprises a flanged sleeve 91 that is splined to the horizontal rotary shaft 49 with a key 83, a bevel gear 92 rotatably mounted on the horizontal rotary shaft 49 and meshing with the bevel gear 92 which meshes with the bevel gear 88 on the processing tank. The friction coupled transmission device 90 further includes a friction member 93 interposed between the bevel gear 92 and the flanged sleeve 91, and an elastic biasing member 94 such as a synthetic rubber which elastically expands so as to press the flanged sleeve 91 against the bevel gear 92 through the friction member 93 for operational coupling with a predetermined force. The elastic biasing member 94 is fixed by means of a retainer ring 95 securely mounted on the horizontal rotary shaft 49 by set screws 92. The bevel gear 92 is prevented from axially moving on the horizontal rotary shaft 49 by means of a stop ring 96 securely mounted on the horizontal rotary shaft 49 by set screws 98.

A friction force produced between the flanged sleeve 91 and the bevel gear 92 can be varied by shifting the retainer ring 95 on the horizontal rotary shaft 49 to compress the elastic biasing member 94. The friction force is adjusted, on one hand, to rotate the flanged sleeve 91 and the bevel gear 92 coupled together when moving the guide channel members 12*a* and 12*b* merely to adjust the distance between the guide channel members 12*a* and 12*b* and, on the other hand, to produce a slippage between the flanged sleeve 91 and the bevel gear 92, thereby allowing only the flanged sleeve 91 to rotate leaving the bevel gear 92 subject to an excessive load if the guide channel members 12*a* and 12*b* are at the outermost positions of movement.

A motor 50 connected to one end of the horizontal rotary shaft 49 is controlled by means of the controller 51 which receives an initializing signal SI and a paper width signal SW. The controller 51 controls the motor 50 to effect sequential operation of the guide channel members 12*a* and 12*b*. This operation includes the steps of moving the guide channel members 12*a* and 12*b* apart from each other upon reception of the initializing signal SI, stopping when the guide channel members 12*a* and 12*b* reach their outermost position, which is detected by limit sensors 102 and moving the guide channel members 12*a* and 12*b* closer to each other to adjust the distance therebetween to the desired width of the color paper 1 upon generation of the paper width SW.

The limit sensor 102 comprises a magnet 103 incorporated in or mounted on the interface gear 84 of the processing tank and a lead switch 102 which is activated when the magnet 103 is adjacent thereto. It is understood that the limit sensor 102 can be replaced with any known sensor that detects the rotational motion of the idler gear 84, of the bevel gear 88 or of the bevel gear 92. It is also understood that the limit sensor 102 can be replaced with a timer which detects the time necessary for the guide channel members 12*a* and 12*b* to move from an outermost position of movement to the initial position to stop the motor 50.

In operation when the guide rack structure is installed, the controller 51 receives an initializing signal SI and actuates the motor 50 to rotate the horizontal rotary shaft 49 in one direction to move the guide channel members 12*a* and 12*b* apart from each other. At the outermost position of movement, the limit sensor 102 provides an initial position signal when the guide channel members 12*a* and 12*b* are moved to the initial position. At the same time, the friction coupled transmission device 90 begins to slip. Because the respective guide rack structures are independent from one another, the respective guide channel members 12*a* and 12*b* may reach their initial position at different times. In this event, any friction coupled transmission device 90 which belongs to the guide rack structure, where guide channel members 12*a* and 12*b* have reached the initial position produces slippage between its bevel gear 92 and flanged sleeve 91 until all of the remaining guide channel members reach their initial position.

When all of the limit sensors 102 detect guide channel members 12*a* and 12*b* at the initial position, the controller 51 reverses the motor 50 to move the guide rack members 12*a* and 12*b* closer to each other according to the paper width signal SW, thereby adjusting the distance between the guide channel members 12*a* and 12*b* of each guide rack structure. In such a way, the distance between the guide channel members 12*a* and 12*b* of each guide rack structure can be adjusted to any desired width according to the paper width signal.

It is noted in this embodiment that the friction coupled transmission device 90 can be provided between the bevel gear 88 and the interface gear 84 and that the motor 50 may be replaced with a manually operated handle incorporating the horizontal rotary shaft 49 in order to rotate it in the opposite directions.

Figure 10:
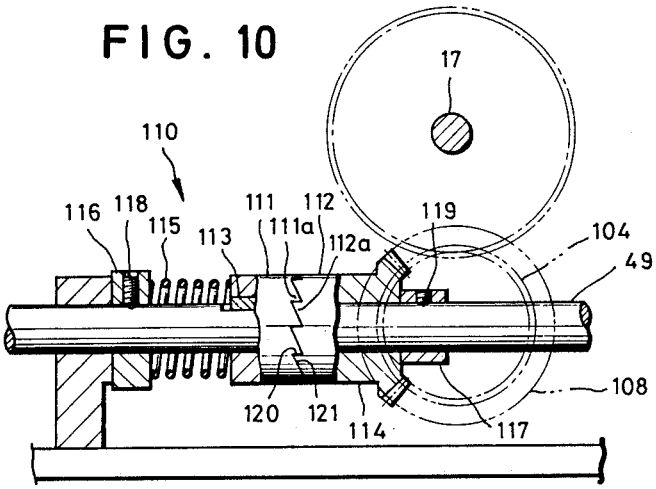
FIG. 10 is a side view showing, partly in cross section, a power transmission alternately used in the photographic processing apparatus shown in FIG. 8.

Referring now to FIG. 10, there is shown another width adjusting mechanism embodying the present invention which is similar in structure and operation to that of the previously described embodiment shown in FIG. 9 except for the transmission device. Therefore, the following description is directed to structural and operational details of the transmission device.

As shown in FIG. 10, the width adjusting mechanism 30 includes a mechanical coupling transmission device 110, in place of the friction coupled transmission 90 of FIG. 9. The transmission device 110 has a self-releasable one way clutch including a movable clutch disk 111 axially slidably mounted on but rotationally secured to the horizontal rotary shaft 49 by means of a sliding key 113, and a clutch disk 112 rotationally mounted on the vertical rotary shaft 49. The clutch disks 111 and 112 are formed with buttress teeth 111*a* and 112*a*, respectively, which mesh with each other in one direction to couple together, but are self-releasable in the opposite direction. The clutch disk 112 has a bevel gear 114 formed at one end which meshes with the bevel gear 88. The movable clutch disk 111 is axially biased by means of a coil spring 115 to bring the teeth 111*a* of the movable clutch disk 111 into mesh with the teeth 112*a* of the clutch disk 112. The coil spring 115 is retained by means of an annular retainer ring 116 mounted on and secured to the horizontal rotary shaft 49 by set screws 118. The clutch disk 112 is prevented from axially moving along the horizontal rotary shaft 49 by means of an annular ring 117 mounted on and secured to the horizontal rotary shaft 49 by set screws 119.

Torque transmitted between the movable clutch disk 111 and clutch disk 112 may be varied by axially shifting the retainer ring 116 along the horizontal rotary shaft 49 to compress the biasing spring 115. The transmittable torque is adjusted to allow slippage between the slanted surfaces of the teeth 111*a* and 112*a* of the clutch disks 111 and 112 to axially move back the movable clutch disk 111 against the biasing spring thereby releasing the one way clutch 110, when the movable clutch disk 111 rotates in the opposite direction. However, the one way clutch 110 is continually locked when the movable clutch disk 111 rotate in a first direction through the engagement of the vertical surfaces of the teeth 111*a* and 112*a* of the clutch disks 111 and 112. Slippage between teeth 111*a* and 112*a* results when the bevel gear 114 is subjected to an excessive load from the guide channel members 12*a* and 12*b* at their outermost positions of movement.

It is noted also in this embodiment that the transmission device 110 can be provided between the bevel gear 88 and the interface gear 84 and that the motor 50 may be replaced with a manually operated handle incorporating the horizontal rotary shaft 49 to rotate it in the opposite directions.

Figure 11:
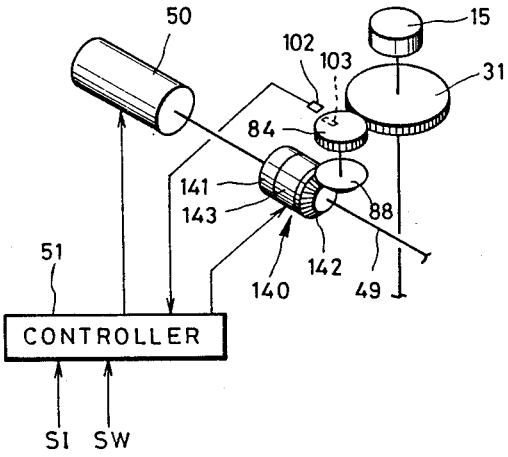
FIG. 11 is a schematic perspective view, similar to 8, showing the essential part of a photographic processing apparatus according to still another preferred embodiment of the present invention.

Referring now to FIG. 11, there is shown still another preferred embodiment of the present invention which is similar in structure and operation to the operations of the previously described embodiments excepting that the transmission device is different from that of the previous embodiment shown in FIG. 9 or the mechanical coupling transmission device 110 shown in FIG. 10. Therefore, the following description is directed to structural and operational details of the transmission device.

As shown in FIG. 11, the width adjusting mechanism 30 includes an electric transmission device 140 including an electric clutch which includes a movable clutch disk 141 axially slidably mounted on but rotationally secured to the horizontal rotary shaft 49 by means of a sliding key (not shown), a solenoid clutch disk 143 rotatably mounted on the horizontal rotary shaft 49 meshing with the bevel gear 88. The solenoid clutch disk 143 contacts the movable clutch disk 141 and the bevel gear 143 to couple them together or uncouple them.

In more detail, when the controller 51 receives a signal from the limit sensor 102, when the guide channel members 12*a* and 12*b* reach their outermost positions of movement, namely their initial position, it energizes the solenoid clutch disk 143 to uncouple the movable clutch disk 141 and the bevel gear 152. As a result, the transmission device 140 disconnects the transmission of rotation of the motor 50 to the bevel gear 88. When the controller 51 receives signals from all of the limit sensors 102 for the respective guide rack structures, the controller 51 deenergizes the solenoid clutch disk 143 to couple the movable clutch disk 141 and the bevel gear 142. As a result, the drive gear 31 of the width adjusting mechanism 30 is coupled through the interface gear 84 and the motor 50 moves the guide channel members 12*a* and 12*b* closer to each other to adjust the distance therebetween according to the width signal SW indicating the width of the long strip of color paper 1.

Although the invention has been fully described by the preferred embodiments thereof with reference to the accompanying drawings it is to be noted that various changes and modifications are apparent to those skilled in the art. Therefore, unless such changes and modifications otherwise depart from the scope of the invention, they should be construed as included therein.

What is claimed is:

1. A photographic processing apparatus having a plurality of processing tanks and a guide rack structure detachably mounted on said processing tanks for guiding a long strip of photographic material passing through said processing tanks, said guide rack structure comprising:

a plurality of pairs of guide members, each of which is removably installed into each of said plurality of processing tanks, said guide members being movable toward and apart from each other to define a width of guide passage therebetween for guiding lengthwise edges of said long strip of photographic material passing through said processing tanks;

a plurality of width adjusting means, each cooperating with one of said plurality of pairs of guide members for adjusting said width of guide passage to be equal to a width of said long strip of photographic material;

drive means mounted on said processing apparatus, connected to said plurality of width adjusting means for driving said plurality of width adjusting means to effect said adjustment of said width of guide passage; and coupling means provided between said drive means and said plurality of width adjusting means for connecting and disconnecting transmission of drive power from said drive means to said width adjusting means.

2. A photographic processing apparatus as defined in claim 1, wherein said driving means comprises:

a reversible motor; and a rotary shaft connected to said reversible motor and extending over said processing tanks.

3. A photographic processing means as defined in claim 2, wherein said coupling means couples said drive means and said plurality of width adjusting means together only when said plurality of pairs of guide members are moved to their outermost positions of movement upon installation of said guide rack structure into said processing tanks.

4. A photographic processing means as defined in claim 3, wherein said coupling means includes clutch means comprising:

a clutch disk having a clutch key formed thereon;

and a clutch disk having a clutch groove formed thereon, said clutch groove being engageable with said clutch key, one of said clutch disks being rotationally coupled to said rotary shaft of said drive means and the other of said clutch disks being connected to said width adjusting means.

5. A photographic processing apparatus as defined in claim 4, wherein said one of said clutch disks has a bevel gear which meshes with a bevel gear member secured to said rotary shaft.

6. A photographic processing apparatus as defined in claim 1, wherein said driving means comprises:

a slidable member having a rack, said slidable member being guided by a guide member secured to said processing tanks;

an engaging member formed integrally with said guide member; and a pinion gear member meshing with said rack and having an engaging portion engageable with said engaging member of said guide member only when said plurality of pairs of guide members are moved to their outermost positions of movement upon installation of said guide rack structure into said processing tanks.

7. A photographic processing apparatus having a plurality of processing tanks and a guide rack structure detachably mounted on said processing tanks for guiding a long strip of photographic material passing through said processing tanks, said guide rack structure comprising:

a plurality of pairs of guide members, each pair of guide members being removably installed in one of said plurality of processing tanks, and being movable toward and apart from each other to define a width of guide passage therebetween for guiding lengthwise edges of said long strip of photographic material passing through said processing tanks;

a plurality of width adjusting means, each connected with one of said plurality of pairs of guide members for adjusting said width of guide passage to be equal to a width of said long strip of photographic material;

drive means mounted on said photographic processing apparatus connected to said plurality of width adjusting means for driving said plurality of width adjusting means to effect said adjustment of said width of guide passage;

clutch means provided between said drive means and said plurality of width adjusting means for transmitting drive power from said drive means to said plurality of width adjusting means but allowing slippages between a rotary shaft of said drive means and said plurality of width adjusting means when said plurality of pairs of guide members are moved to their outermost positions of movement; and coupling means for coupling said clutch means to said plurality of width adjusting means during installation of said guide rack structure into said processing tanks.

8. A photographic processing apparatus as defined in claim 7, wherein said driving means comprises a reversible motor connected to said rotary shaft which extends over said plurality of processing tanks.

9. A photographic processing apparatus as defined in claim 7, further comprising a plurality of position sensors, one for each of said plurality of guide members, each position sensor detecting when said pair of guide members are disposed at said outermost positions of movement.

10. A photographic processing apparatus as defined in claim 9, wherein said reversible motor of said drive means is reversed when all of said position sensors detect said guide members moved to said extremity of movement.

11. A photographic processing apparatus as defined in claim 8, wherein said clutch means comprises:

a movable member axially slidably mounted on said rotary shaft;

a bevel gear member rotatably mounted on said rotary shaft;

a friction member disposed between said movable member and said bevel gear member; and biasing means for biasing axially said movable member to change a friction force produced between said movable member and said bevel gear member through said friction member.

12. A photographic processing apparatus as defined in claim 11, wherein said biasing means comprises:

an elastic member mounted on said rotary shaft, in axial contact with said movable member; and a retainer axially shiftably mounted on said rotary shaft to compress said elastic member against said movable member.

13. A photographic processing apparatus as defined in claim 8, wherein said clutch means comprises:

a movable member axially slidably mounted on said rotary shaft, having teeth at one end;

a bevel gear member rotatably mounted on said rotary shaft having teeth which mesh with said teeth of said movable member; and biasing means for biasing axially said movable member to maintain said teeth of said movable member and said teeth of said bevel gear member coupled together during rotation in one direction and allowing slippage between said movable member and said bevel gear member during rotation in an opposite direction.

14. A photographic processing apparatus as defined in claim 13, wherein said biasing means comprises:

a coil spring member mounted on said rotary shaft, in axial contact with said movable member and a retainer axially and shiftably mounted on said rotary shaft compressing said coil spring member against said movable member.

15. A photographic processing apparatus as defined in claim 8, wherein said clutch means comprises:

a first clutch disk rotating integrally with said drive means;

a second clutch disk rotationally mounted on said rotary shaft; and an electric solenoid clutch means releasably coupling said first and second clutch disks together for transmitting of power from said drive means to said width adjusting means.

16. A photographic processing apparatus as defined in claim 9, wherein said clutch means comprises:

a first clutch disk rotating integrally with said drive means;

a second clutch disk rotationally mounted on said rotary shaft; and an electric solenoid clutch means releasably coupling said first and second clutch disks together for transmitting of power from said drive means to said width adjusting means.

17. A photographic processing apparatus as defined in claim 16, wherein said clutch means releases coupling of said clutch disks when said plurality of position sensors detect said plurality of pairs of guide members disposed at said outermost positions of movement.

18. A photographic processing apparatus having a plurality of processing tanks and a guide rack structure detachably mounted on said photographic processing apparatus for guiding a long strip of photographic material passing through said processing tanks, said guide rack structure comprising:

a plurality of pairs of guide members installed in said apparatus so that one pair is disposed in each of said plurality of processing tanks, each said pair of guide members being movable toward and apart from each other to define a width of guide passage therebetween to guide lengthwise edges of said long strip of photographic material passing through each of said processing tanks;

a plurality of width adjusting means coupled to each of said plurality of pairs of guide members for adjusting said width of guide passage to be equal to a width of said long strip of photographic material;

drive means comprising a motor and a rotary shaft connected to said motor, mounted on said photographic processing apparatus to cooperate with all of said plurality of width adjusting means to drive them, thereby effecting said adjustment of said width of guide passage;

power transmission means disposed between said drive means and said plurality of width adjusting means, for connecting and disconnecting the transmission from drive power of said drive means to said plurality of width adjusting means; and control means for reversing rotation of said motor when all of said pairs of guide members have been moved to outermost positions of movement.

19. A photographic processing apparatus as defined in claim 18, wherein said transmission means comprises a coupling member of operationally coupling said power transmission means to said plurality of width adjusting means.

20. A photographic processing apparatus as defined in claim 18, wherein said control means comprises a plurality of sensors, one for each pair of guide members for detecting whether each of said pairs of guide are disposed at said outermost positions of movement.

* * * * *